United States Patent [19]

Marcandalli

[11] 4,178,864

[45] Dec. 18, 1979

[54] LOOPER CONTROL APPARATUS FOR SEWING MACHINES

[75] Inventor: Ulderico Marcandalli, Milan, Italy

[73] Assignee: Rockwell-Rimoldi, S.p.A., Milan, Italy

[21] Appl. No.: 840,084

[22] Filed: Oct. 6, 1977

[30] Foreign Application Priority Data

Nov. 2, 1976 [IT] Italy ..... 28954 A/76

[51] Int. Cl.[2] ..... D05B 3/00; D05B 57/32

[52] U.S. Cl. ..... 112/159; 112/200

[58] Field of Search ..... 112/159, 199, 200

[56] References Cited

U.S. PATENT DOCUMENTS

| | | | |
|---|---|---|---|
| 1,919,852 | 7/1933 | Lutz | 112/159 |
| 2,345,327 | 3/1944 | Clayton | 112/200 |
| 2,840,021 | 6/1958 | Lutz | 112/159 |
| 3,192,886 | 7/1965 | Cash, Jr. | 112/199 X |
| 3,783,810 | 1/1974 | Marforio | 112/159 |

FOREIGN PATENT DOCUMENTS

| | | | |
|---|---|---|---|
| 540000 | 2/1977 | U.S.S.R. | 112/159 |

*Primary Examiner*—Wm. Carter Reynolds

[57] ABSTRACT

An apparatus for controlling movement of a looper while forming zig-zag stitches in a sewing machine. The apparatus is provided with a first drive device for moving and maintaining the looper in alignment with the machine's needle and a second drive device for causing the looper to travel in planes which are parallel when moving to cooperate with the needle in each of its stitch forming positions.

2 Claims, 2 Drawing Figures

LOOPER CONTROL APPARATUS FOR SEWING MACHINES

BACKGROUND OF THE INVENTION

The present invention pertains to a looper control apparatus for chain-stitch zig-zag sewing machines and more specifically, for making a very wide zig-zag stitch, and for multi-stitch zig-zag. As is well-known, in zig-zag machines the looper travels in an essentially elliptical path while the needle successively travels in two or more parallel, vertical and spaced pathways in order to cover the desired width of the stitch and to cooperate with the looper so as to link the thread of the needle with that of said looper.

When the width of the zig-zag stitch is increased, difficulties arise in the formation of the stitch, due to the fact that the needle is caused to be moved laterally to positions that are of greater distance from the starting point of the looper as said needle moves away from the position in alignment with its initial penetration of the fabric.

This movement of the needle from the position in alignment with its initial penetration of the fabric results in an increase in its lateral movement which increases with the increase in the width of the zig-zag stitch to be covered.

As operation of the looper is determined when the needle is at its point of initial penetration, it is obvious that the constant speed of the looper drive is no longer adequate to compensate for the increase in distance that is present with each successive penetration of the needle during its lateral movements.

Under such conditions it is very likely that the penetrations following those stitches in alignment with the needle's initial penetration will be missed, because the needle and the looper do not meet under the same conditions as those stitches formed in alignment with said needle's initial penetration of the fabric.

In order to obviate the difficulties described above, devices are known which provide for the alternate shifting of the starting point of the looper as the needle moves away from the stitches in alignment with its initial penetration. In order to accomplish this, the pin around which the looper support oscillates is shifted in the same direction and distance as the needle.

This device, however, has a disadvantage, owing to the different position of the looper from that of the needle relative to the successive penetrations of the latter. This is due to the different angles that the looper assumes according to the repeated positions assumed by the above-mentioned pin. This, in turn, is due to the fact that the pin on which the looper drive shaft pivots does not move in correspondence with the pin on which the looper support oscillates.

The present invention proposes to obviate the difficulties mentioned above and provide the desired form of zig-zag chain stitch irrespective of the width of the stitch and the number of penetrations per lateral movement in both directions of the needle.

The problem has been solved by providing a means which causes the looper to assume positions which provide the same operative association between it and the needle with each successive penetration and position of the latter.

SUMMARY OF THE INVENTION

The present invention provides a drive device having means for moving the looper simultaneously the same distance and direction as the needle during each lateral movement thereof and is effective in each position in moving said looper for cooperation with said needle so that it travels in a plane parallel to that which it traveled to form the preceding stitch.

Other features and advantages of the present invention will be made apparent in the following detailed description thereof provided with reference to the accompanying drawing, in which:

DESCRIPTION OF THE PREFERRED EMBODIMENT

Figure 1:
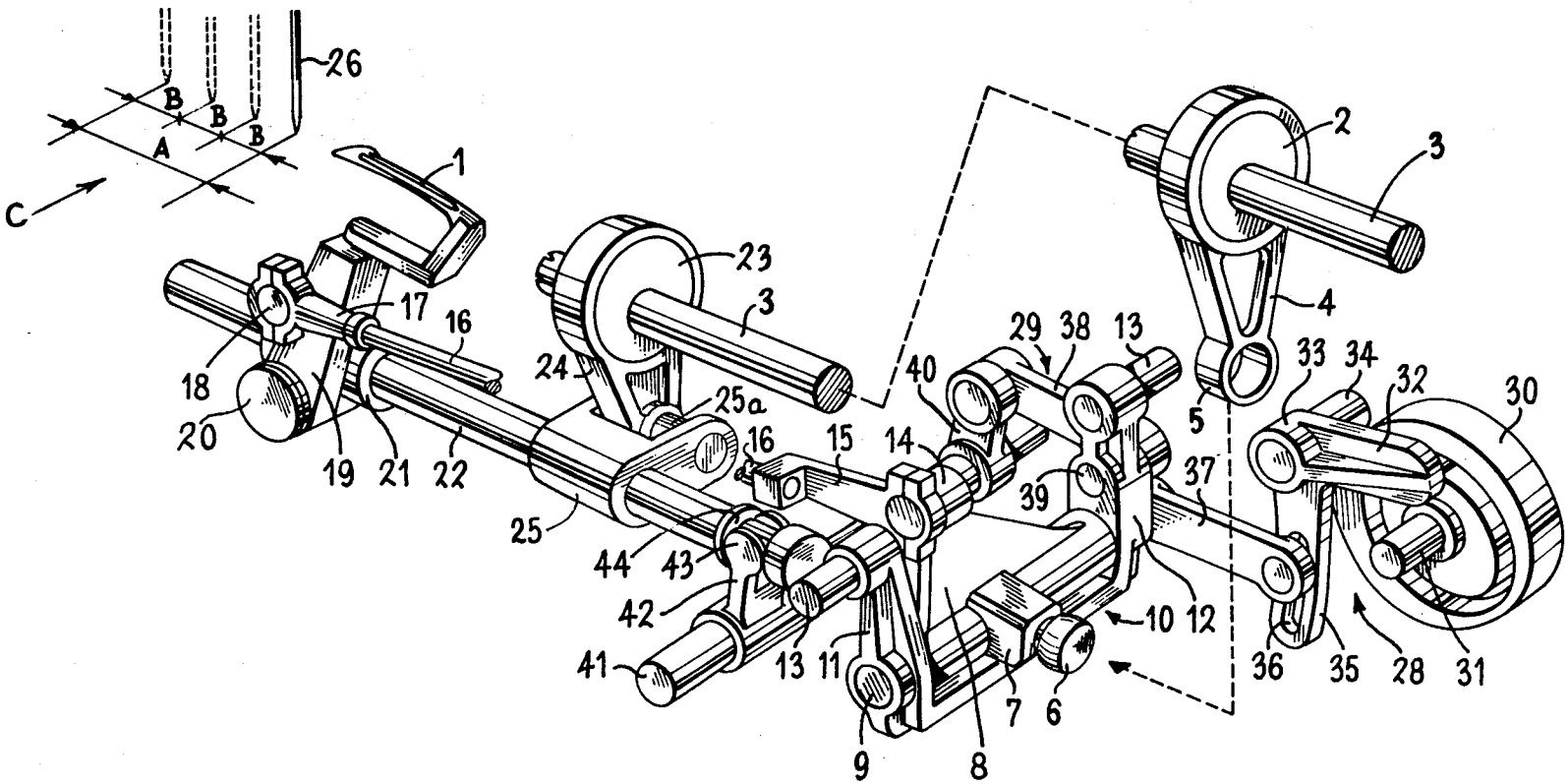
FIG. 1 is a perspective view of the looper drive device according to the invention.

Referring now to the drawing, the apparatus according to the invention includes a first drive device connected to a looper support bracket for effecting movement of a looper 1 in a direction perpendicular to the direction in which the workpiece is caused to travel Additionally this first drive device is effective in maintaining the looper in alignment with the needle in each of the latter's positions so that it will successively take up and release the loop of the thread from the needle. The apparatus also includes a second drive device functioning in timed sequence with the first drive device which provides an oscillating movement of the looper 1 in the direction in which the workpiece travels and which is effective in moving said looper to and from operative association with the needle in a plane parallel to that which it traveled to form each preceeding stitch so that it will avoid said needle after the loop of thread has been taken up. As shown in FIG. 1 the direction of movement of a workpiece is depicted by the indicating arrow identified by the letter C.

Figure 2:
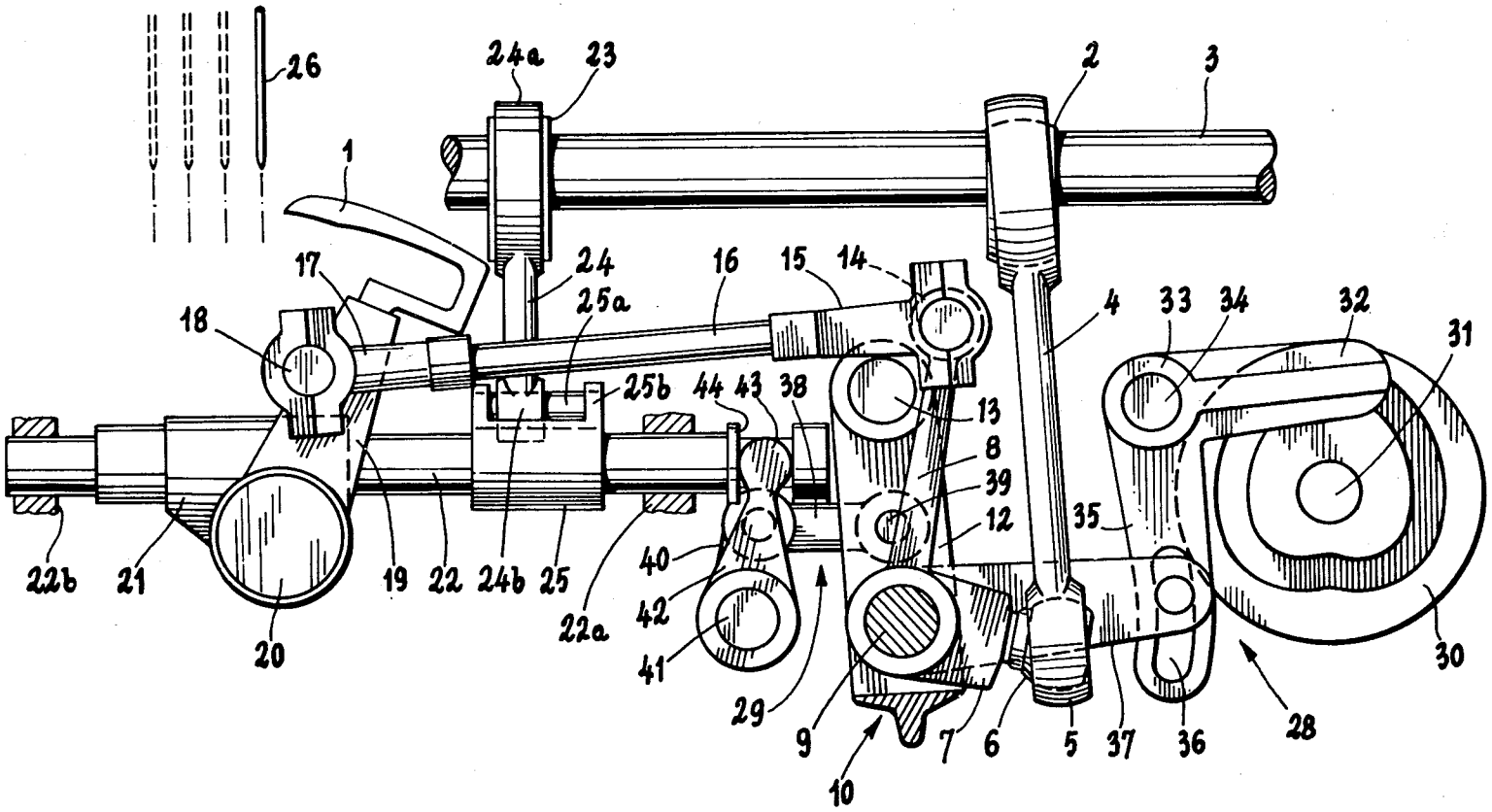
FIG. 2 is a view in side elevation of the device shown in FIG. 1.

According to the present invention, the first drive device includes an eccentric cam 2 that is fixed on the sewing machine's main shaft which is identified by numeral 3 and which in a known manner is rotatably mounted within the machine. The outer periphery of the eccentric cam 2 defines a sperical bearing surface as shown in FIG. 2 and is operatively associated with a mating surface formed on one end of a connecting rod 4. The opposite end of the connecting rod 4 is identified by numeral 5 and also has a configuration within which a sperical bearing surface of the actuating end 6 of a control arm 7 is adapted to assemble. This actuating end 6 is integrally formed on the end of the control arm 7 of a looper drive lever identified by numeral 8. The mechanical connection between the eccentric cam 2 and the control arm 7 is effective in causing an oscillating movement of the looper drive lever 8 which is mounted on a pair of spaced rod members 9. These rod members 9 are assembled in a forked support bracket 10 having opposed arms 11 and 12 each of which include a support pin 13 that serve to pivotably mount said support bracket within the frame (not shown) of the sewing machine. Numeral 14 identifies that end of lever 8 which pivotably supports one end 15 of a looper drive rod 16. The opposite end of this looper drive rod 16 is shown at 17 and is pivotably attached to a pin 18 which forms an integral part of a support bracket 19 that has the looper 1 fixedly attached to the upper surface thereof. The lower end of the support bracket 19 is pivotably mounted on a pin 20 which forms an integral part of a coupling 21 that is assembled on an oscillatably and longitudinally driven shaft 22. As shown in FIG. 2 this driven shaft 22 is supported within the machine by a pair of spaced bearing members **22*a* and 22*b* and forms a part of the second drive device which includes an eccentric cam 23 that is keyed on shaft 3 and is operatively connected to an end identified by numeral 24*a* of a connecting rod 24. The opposite end of this connecting rod 24 is depicted by numeral 24*b* and is pivotably and slidably attached to a pin 25*a* which assembles between a pair of spaced arms 25*b* that are integral with and extend from a sleeve 25 that is fixed by any suitable means on the driven shaft 22. This mechanical connection between the eccentric cam 23 and the driven shaft 22 is effective in causing oscillating movement of said shaft about its axis so as to move the looper clear of the needle after the loop of thread has been taken by the latter and also permit said shaft to be moved along said axis by the first drive device in timed sequence with the stitching cycle. To form a proper zigzag chain stitch, irrespective of the total width of the stitch A, as defined by the sum of the partial widths B between two successive penetrations of the material by the needle 26, actuating elements are provided to cause the support bracket 19 on which the looper 1 is mounted to move in planes which are parallel when shifted to positions for operative cooperation with the needle 26. The support bracket 19 is caused to be shifted a distance equal to width B which is covered by the needle 26. The abovementioned actuating elements that serve to shift the support bracket 19 includes a control device generally indicated by numeral 28 that is operatively connected to the forked support bracket 10 which carries the looper drive lever 8, and a linking apparatus 29 which forms a part of the second drive device operatively connectes said forked support bracket 10 with the driven shaft 22 on which the said support bracket is located. The control device 28 is provided with a grooved cam 30 that is fixed on a rotatably driven shaft 31 that is driven by the same means (not shown) for driving shaft 3 and that is operatively engaged by a follower arm 32 of a bell crank lever 33. This bell crank lever 33 is pivotably mounted on a stud 34 which assembles in the frame of the machine. The other arm of the bell crank lever 33 is identified by numeral 35 and is provided with a slotted opening 36 for adjustably locating one end of a pivotable link member 37. The opposite end of link member 37 is pivotably mounted on an extension of one of the rods 9 that pivotably supports one side of the looper drive lever 8 in the forked support bracket 10. The linking apparatus 29 is provided with a connecting link 38 having one end thereof pivotably mounted on a pin 39 which is carried in the arm 12 of the forked support bracket 10. The opposite end of connecting link 38 is pivotably connected to an upwardly extending arm 40 which is fixed on a transverse shaft 41 the ends of which are suitably journaled in the frame of the machine. A bifurcated lever 42 is fixed on shaft 41 and its bifurcated end 43 is disposed in operative association with a ringed groove 44 which forms a part of the driven shaft 22. The rotation of the cam 30 in relation to that of shaft 3 is such that, with one complete rotation of the cam, the shaft 3 completes as many rotations as there are penetrations of the needle 26 subsequent to its initial penetration. It should be understood at this point that the shaft 3 which controls the complete oscillation of the looper and the shaft that governs the alternate movements of the needle 26 have a transmission ratio of 1 to 1. The profile of the cam 30 is such that for every fraction of rotation of said cam, the forked support bracket 10 is pivoted to a predetermined angle around its support pins 13 which causes both the looper drive lever 8 and the driven shaft 22 to be shifted from their initial position by an amount equal to the width of the partial displacement B of the needle 26. Within the range of a particular type of zig-zag stitch, as for example, the stitch represented in the drawing, where for each complete lateral movement of the needle three successive stitches are formed, and the value of the width of the partial movements B may be varied as desired by appropriate regulation of the position of the link member 37 in the slotted opening 36 of the bell crank lever 33. The respective movements of the cam 30, the connecting link 38 by means of the forked support bracket 10 and the linking apparatus 29 control the movement of the oscillatably driven shaft 22** in timed sequence with the lateral movement of the needle, which is moved by means not shown. The lateral movement of the looper is such that at the beginning of its movement, or when it is matched with its right dead center and the needle is matched with its lower dead center, there is an identical phasing and positioning of the looper for each stitch that constitutes the zig-zag.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

I claim:

1. A looper control apparatus for chain stitch sewing machines having a needle laterally movable to positions to form zig-zag stitches in a workpiece and a looper support bracket for controlling movement of the machine's looper to and from operative associaton with the needle in each of its stitch forming positions, said looper control apparatus comprising:

(a) a first drive device connected to the looper support bracket including;
  (i) a control device (28);
  (ii) a forked support bracket (10) operatively connected to said control device having an oscillatably driven looper drive lever (8) pivotably mounted therein for effecting oscillating movement of the looper in a direction perpendicular to the direction of travel of the workpiece and to maintain the looper in alignment with the needle in each of its lateral positions.

(b) a second drive device connected to the looper support bracket and functioning in timed sequence with said first drive device including:
  (i) a linking apparatus (29) interconnecting said forked support bracket (10) with a driven shaft (22) on which the looper support bracket is mounted for effecting longitudinal movement of said driven shaft and move the looper to and from operative association with the needle in a plane parallel to that which it traveled to form each preceeding stitch; and (c) said control device (28) including a grooved cam (30) having a follower arm (32) of a bell crank lever (33) connected thereto and a link member (37) operatively interconnecting the latter with said forked support bracket (10) and linking apparatus (29).

2. The looper control apparatus according to claim 1 wherein said linking apparatus (29) includes a connecting link (38) operatively interconnecting said forked support bracket (10) with a transverse shaft (41), and said transverse shaft having a bifurcated lever (42) fixed thereon in operative association with said driven shaft (22) for effecting longitudinal movement thereof.

* * * * *